US006879094B2

(12) United States Patent
Choi

(10) Patent No.: US 6,879,094 B2
(45) Date of Patent: Apr. 12, 2005

(54) MASK FRAME FOR CATHODE RAY TUBE

(75) Inventor: Oh-Yong Choi, Kumi (KR)

(73) Assignee: LG. Philips Displays Korea Co., Ltd., Kyeongsangbuk-Do (KR)

( * ) Notice: Subject to any disclaimer, the term of this patent is extended or adjusted under 35 U.S.C. 154(b) by 4 days.

(21) Appl. No.: 10/391,771

(22) Filed: Mar. 20, 2003

(65) Prior Publication Data

US 2003/0222564 A1 Dec. 4, 2003

(30) Foreign Application Priority Data

May 29, 2002 (KR) ..... 10-2002-0029976
Jan. 9, 2003 (KR) ..... 10-2003-0001371

(51) Int. Cl.[7] ..... H01J 29/80
(52) U.S. Cl. ..... 313/407; 313/402; 313/408
(58) Field of Search ..... 313/402, 407, 313/408, 477 R, 461

(56) References Cited

U.S. PATENT DOCUMENTS 6,030,268 A * 2/2000 Lee ..... 445/30
6,268,688 B1 * 7/2001 Tani et al. ..... 313/402
6,635,981 B2 * 10/2003 Tani et al. ..... 313/407
6,707,242 B2 * 3/2004 Ito et al. ..... 313/402

FOREIGN PATENT DOCUMENTS

JP 11-329279 A 11/1999
KR 2000-0066352 A 11/2000

* cited by examiner

*Primary Examiner*—Joseph Williams
*Assistant Examiner*—Kevin Quarterman
(74) *Attorney, Agent, or Firm*—Birch, Stewart, Kolasch & Birch, LLP

(57) ABSTRACT

A color cathode ray tube comprising a panel having a substantially flat outer surface, a funnel mounted on a rear side of the panel, a shadow mask including a plurality of electron beam through holes, and a mask frame for supporting the shadow mask, said mask frame satisfying the following condition: $d/v \geqq 0.9$, $d/h \geqq 0.9$ wherein d is a height of a center of a diagonal portion of the mask frame, h is a height of a center of a short side portion of the mask frame, and v is a height of a center of a long side portion of the mask frame.

24 Claims, 12 Drawing Sheets

$$\text{Purity Margin} = \frac{((2Bd+Gs)-Bg)}{2}$$

MASK FRAME FOR CATHODE RAY TUBE

BACKGROUND OF THE INVENTION

1. Field of the Invention

The present invention relates to a mask frame for a cathode ray tube and particularly, to a mask frame for a cathode ray tube, capable of increasing purity margin of a screen.

2. Description of the Background Art

Generally, as shown in FIG. 1, a color cathode ray tube includes a panel 3, a funnel 4 coupled with the panel 3 to form a vacuous space, a fluorescent screen 1 coated on the inner surface of the panel 3 and performing a certain luminary function, an electron gun 9 installed at rear side 8 of the funnel 4 and emitting electron beams 11R, 11G and 11B, a shadow mask 5 installed at a rear side of the panel 3 at a certain distance from the fluorescent screen 1, a mask frame 7 for fixing/supporting the shadow mask 5, an elastic support 23 and a stud pin 2 for combining the mask frame 7 with the panel 3, and a deflection yoke 10 for deflecting the electron beams 11R, 11G and 11B to the fluorescent screen 1.

As shown in FIGS. 2 and 3, the three color electron beams 11R, 11G and 11B emitted from the electron gun 9 are deflected by a deflection yoke 10 mounted at an outer side of the funnel 4, and the electron beams pass through the shadow mask 5 and reach to three-color luminescent materials 1R, 1G and 1B respectively having a predetermined width Gs and coated on the fluorescent screen 1 with a predetermined interval Bd.

As depicted in FIGS. 4A and 4B, the shadow mask 5 includes a main surface 22 which is formed as a curved surface in a shape corresponding to a shape of the fluorescent screen 1 and has a plurality of electron beam through holes 12, and a skirt portion 6 curvedly formed to be approximately perpendicular to the main surface 22.

The shadow mask 5 is combined with the mask frame 7 as the skirt portion 6 of the shadow mask 5 is welded to a side portion 13 of the mask frame 7, and the shadow mask 5 is supported inside the panel 3 according as the mask frame 7 is connected to the elastic support 23 engaged with a stud pin 2 installed inside the panel 3.

Also, as shown in FIGS. 5A, 5B and 5C, the mask frame 7 is disposed to be perpendicular to an axis of the cathode ray tube (Z-axis), and is formed to have the side portion 13 which is abutted on the skirt portion 6 of the shadow mask 5.

The conventional cathode ray tube with the above structure implements a screen as the electron beams 11R, 11G and 11B are deflected by the deflection yoke 10, pass through a plurality of electron beam through holes 12 which are formed in the shadow mask 5 and are landed on the fluorescent screen 1 formed on the inner surface of the panel 3, and the luminescent materials 1R, 1G and 1B of the fluorescent screen 1 emit light.

At this time, part of the electron beams 11R, 11G and 11B impinge on the shadow mask 5 without passing through the electron beam through holes 12, and high heat is generated in the shadow mask 5 impingement of the electron beams 11R, 11G and 11B. The heat of the shadow mask 5 is transferred to the mask frame 7, and the heat transferred to the mask frame 7 is transferred to the elastic support 23 and the stud pin 2, thus to emit the heat generated in the shadow mask 5 to the outside of the cathode ray tube. Therefore, deterioration of landing performance resulting from a thermal deformation of the shadow mask 5 and defection of color purity of the screen can be prevented.

Meanwhile, a curvature radius of an outer surface of the panel 3 is infinite, or the outer surface of the panel 3 is substantially flat. Also, a curvature radius of an inner surface of the panel 3 is smaller than the curvature radius of the outer surface of the panel 3.

Also, it is known as efficient that a curvature radius of the shadow mask 5 is the same as or smaller than the curvature radius of the inner surface of the panel 3 to increase mechanical strength of the shadow mask 5.

As shown in FIG. 6, the mask frame has a height h of a long axis of the side portion 13 (a height h of a center of a short side portion of the mask frame 7), a height v of a short axis of the side portion 13 (a height v of a center of a long side portion of the mask frame 7) and a height d of a diagonal axis of the side portion 13 (a height d of a center of a diagonal portion of the mask frame), and the heights h, v and d become larger from a center toward a peripheral portion of the mask frame 7. Further, the height v of the long side portion is higher than the height h of the short side portion, and the height d of the diagonal portion is the lowest among the heights h and v.

On the other hand, for the panel 3 of a color cathode ray tube, coating is applied to the surface of the panel 3 to prevent degradation of contrast quality of the screen due to the external reflection of the panel. That is, a predetermined amount of coating liquid is injected in the center portion of the outer surface of the panel 3, and the coating liquid is applied to the whole surface of the panel 3 by rotating the panel 3. However, it is difficult to apply the coating to the whole surface of the panel uniformly. Also, although a processing for increasing strength of the coating is performed by passing the coating through a furnace after coating, it is difficult to obtain a coating with a preferable degree of strength.

To solve the above problem, the panel is tinted (optical transmittance is 51%) and accordingly, there is no need to use coating liquid. Therefore, the cost of production can be reduced and a defective proportion caused by coating defects can be also reduced, thus to improve productivity. However, in case of the tinted panel, optical transmittance in the peripheral portion of the panel 3 rapidly decreases.

As shown in FIG. 7 and Tables 1, 2 and 3, for example, in case that the thickness Tc of a center portion of the panel 3 is 12.5 mm, the thickness Tco of a peripheral portion of the panel 3 is 27.5 mm which is 220% larger than the thickness Tc of the center portion, and the coating liquid is coated on the outer surface of the panel 3 when the width Gs of the luminescent materials 1R, 1G and 1B of the peripheral portion is 185 $\mu$m, the optical transmittance in the center portion of the panel 3 is 54.41%, and the optical transmittance in the peripheral portion of the panel 3 is 46.51%. That is, degradation of optical transmittance of about 5% in the peripheral portion of the panel 3 is generated.

On the contrary, in case of the tinted panel 3, the optical transmittance in the center portion becomes 51.15% which is similar as the optical transmittance of the coated panel, but the optical transmittance in the peripheral portion falls down to about 25.56% due to the difference of thickness Tc of the center portion and thickness Tco of the peripheral portion of the panel 3. Accordingly, the optical transmittance in the peripheral portion of the tinted panel falls down to about 45% than in the case of the coated panel, and brightness of the peripheral portion is deteriorated.

Therefore, in case of the tinted panel, about 15 fl of degradation of brightness is generated more than in the case of the coated panel. Here, a B/U value represents an index of uniformity of color purity of the screen of the cathode ray tube.

TABLE 1

| panel | thickness of center portion Tc (mm) | thickness of peripheral portion Tco (mm) | width of fluorescent screen at peripheral portion (μm) |
|---|---|---|---|
| size | 12.5 | 27.5 | 185 |

TABLE 2

| tinted panel | | | |
|---|---|---|---|
| width of fluorescent screen of center portion (μm) | width of fluorescent screen of peripheral portion (μm) | direction margin (deg) | B/U (fl) |
| 170 | 185 | 25 | 50 |
| 160 | 230 | 18 | 50 |

TABLE 3

| panel | optical transmittance in center portion (%) | optical transmittance in peripheral portion (%) | B/U (fl) at peripheral portion |
|---|---|---|---|
| coated | 54.41 | 46.51 | 50 |
| tinted | 51.15 | 25.56 | 35 |

Here, the thickness Tco of the peripheral portion of the panel 3 can be reduced so as to improve the optical transmittance in the peripheral portion of the tinted panel. However, since the curvature radius of the shadow mask 5 must be formed corresponding to the curvature radius of the inner surface of the panel 3, the curvature radius of the shadow mask 5 increases when the curvature radius of the inner surface of the panel increases. Therefore, the increase of the curvature radius of the shadow mask causes deformation of the shadow mask by impact, and the increase of the curvature radius of the shadow mask causes degradation of mechanical strength by hauling of the shadow mask, thus to decrease color purity of the cathode ray tube.

In addition, the width Gs of the luminescent materials 1R, 1G and 1B at the peripheral portion can be increased about 24% so as to improve the brightness of the peripheral portion of the panel 3. (Table 2) However, as shown in FIG. 3, in case of increasing the width Gs of the luminescent materials 1R, 1G and 1B, the purity margin that the electron beams 11R, 11G and 11B radiate the luminescent material 1R, 1G and 1B is reduced, thus to cause defection of color purity of the cathode ray tube.

That is, in case that the width Gs of the luminescent material of the peripheral portion increases as 24%, the width Bd of a black stripe is contrarily decreased. Therefore, since the electron beams 11R, 11G and 11B are displaced as about 35 μm by changing the terrestrial magnetism, the purity margin of fluorescent screen is decreased when the width Bd of the black stripe is decreased.

Therefore, to cope with the disadvantage, the amount of the displacement of the electron beam must be reduced in converting the terrestrial magnetism and direction of the terrestrial magnetism.

Generally, to reduce the amount of the displacement of the electron beam, the material of the inner shield (not shown) can be changed or the shape of the inner shield can be changed.

However, cost of the parts increases in changing the material of the inner shield, and it is difficult to reduce absolute amount of the displacement of the electron beam in changing the shape of the inner shield.

On the other hand, as shown in FIGS. 7 and 8, in the conventional cathode ray tube, the inner shield reduces influences of the terrestrial magnetism on the electron beam when the terrestrial magnetism is changed and the direction of the terrestrial magnetism is converted. However, in case that the electron beam passed through an electron beam through hole of the shadow mask is completely exposed to the terrestrial magnetism, and accordingly, the conventional cathode ray tube had a disadvantage that the electron beams 11R, 11G and 11B react with magnetism more sensitively as a distance between the center portion of the panel 3 and the center portion of the shadow mask 5 and a distance between the diagonal portion of the mask frame and the inner surface of the panel are longer, thus to increase the deflection amount of the electron beams.

SUMMARY OF THE INVENTION

Therefore, an object of the present invention is to provide a mask frame for a cathode ray tube, capable of increasing a purity margin by reducing the amount of displacement of the electron beam due to changing of the terrestrial magnetism, by having a height of a diagonal portion of the mask frame higher than that of the conventional art.

To achieve these and other advantages and in accordance with the purpose of the present invention, as embodied and broadly described herein, there is provided a color cathode ray tube, including a panel which has a substantially flat outer surface, a funnel mounted on a rear side of the panel, a shadow mask including a plurality of electron beam through holes, and a mask frame for supporting the shadow mask, said mask frame satisfying the following condition; $d/v \geqq 0.9$, $d/h \geqq 0.9$, wherein d is a height of a diagonal portion of the mask frame, h is a height of a center of a short side portion of the mask frame, and v is a height of a center of a long side portion of the mask frame.

Also, to achieve the object of the present invention, there is provided a color cathode ray tube, comprising a panel which has a substantially flat outer surface, a funnel mounted on the rear side of the panel, a shadow mask including a plurality of electron beam through holes, and a mask frame for supporting the shadow mask, said mask frame satisfying the following condition; $d \geqq h$, $d \geqq v$, wherein d is a height of a diagonal portion of the mask frame, h is a height of a center of a short side portion of the mask frame, and v is a height of a center of a long side portion of the mask frame.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
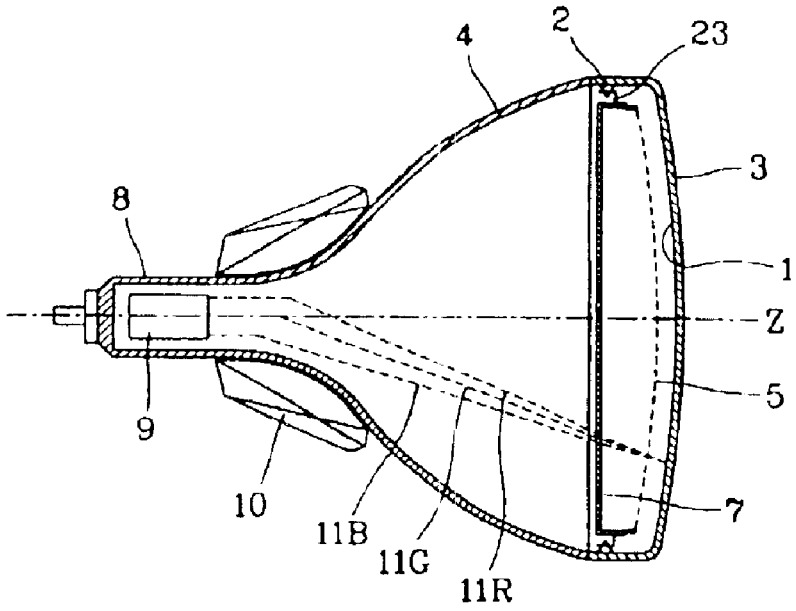
FIG. 1 CONVENTIONAL ART
FIG. 1 is a sectional view showing a cathode ray tube in accordance with the conventional art.
Figure 2:
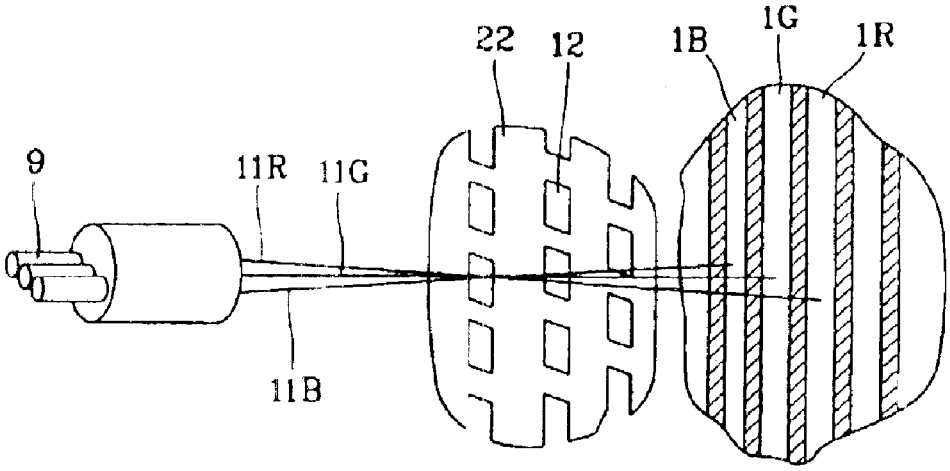
FIG. 2 CONVENTIONAL ART
FIG. 2 is a schematic perspective view showing a condition that an electron beam emitted from an electron gun reaches to a fluorescent screen by passing through the shadow mask of a cathode ray tube in accordance with the conventional art.
Figure 3:
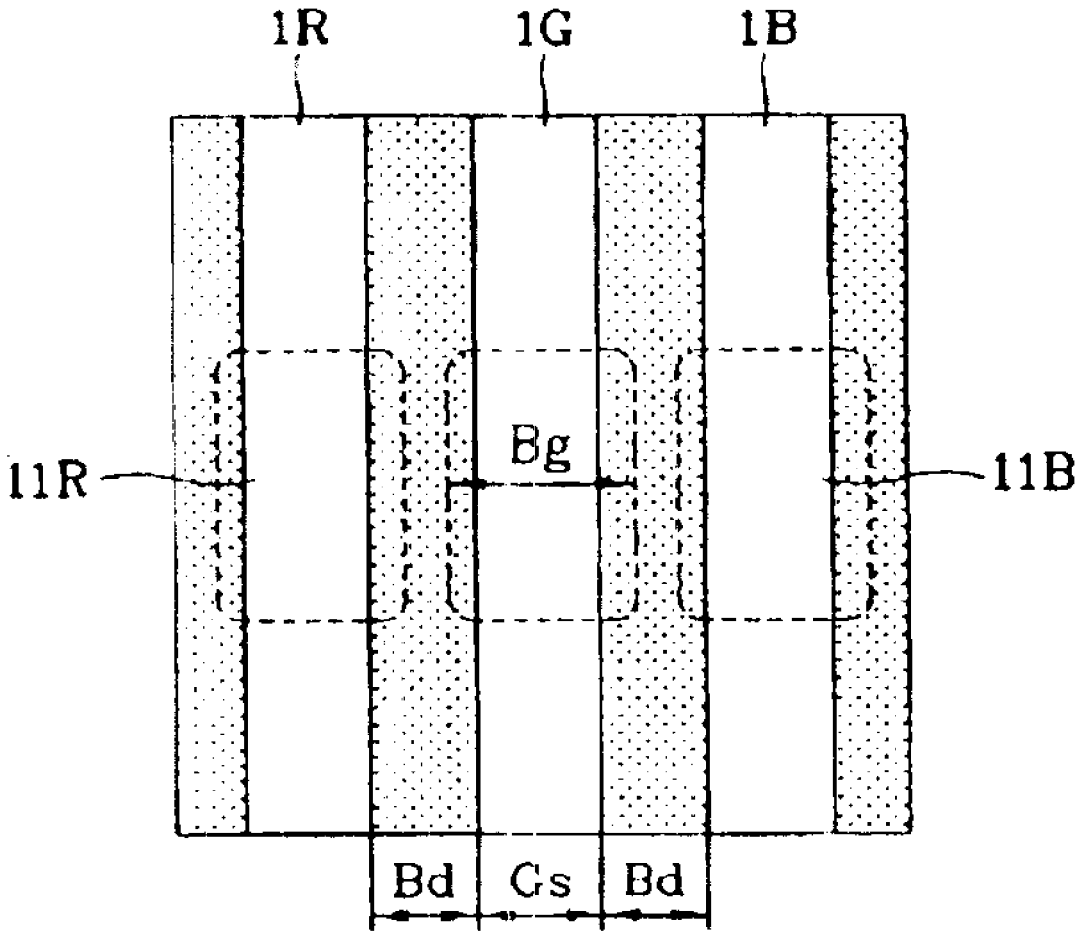
FIG. 3 CONVENTIONAL ART
FIG. 3 is a schematic view showing a fluorescent screen and the corresponding purity margin of the fluorescent screen in a cathode ray tube in accordance with the conventional art.
Figure 4A:
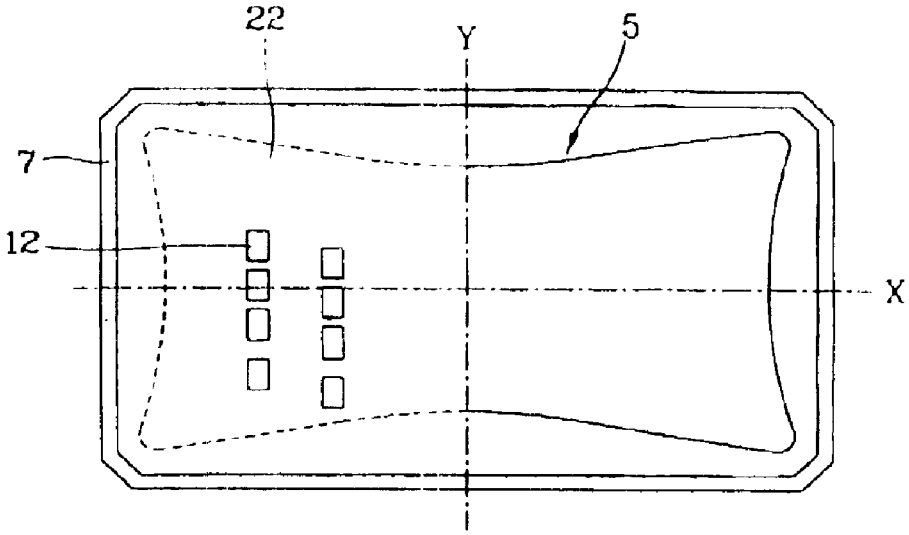
FIG. 4A CONVENTIONAL ART
FIG. 4A is a plan view showing an assembly of a shadow mask and a mask frame of a cathode ray tube in accordance with the conventional art.
Figure 4B:
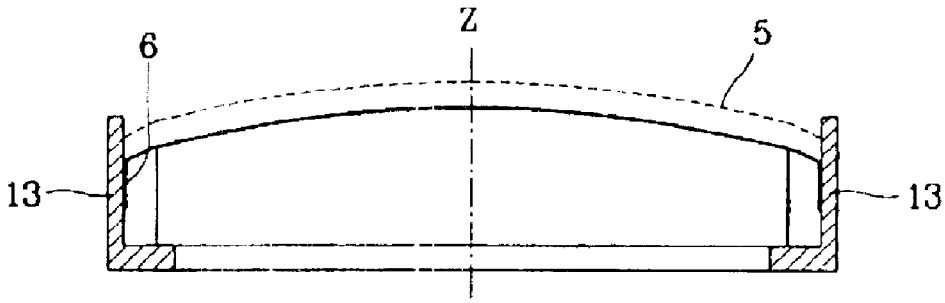
FIG. 4B CONVENTIONAL ART
FIG. 4B is a transverse sectional view of FIG. 4A.
Figure 5A:
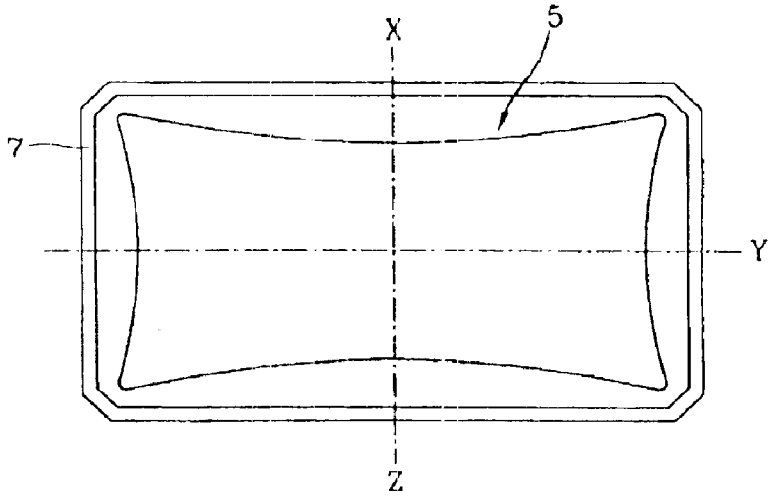
FIG. 5A CONVENTIONAL ART
FIG. 5A is a plan view showing a structure of the mask frame of a cathode ray tube in accordance with the conventional art.
Figure 5B:
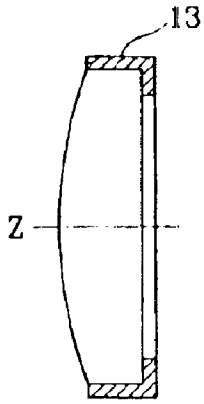
FIG. 5B CONVENTIONAL ART
FIG. 5B is a longitudinal sectional view of FIG. 5A.
Figure 5C:
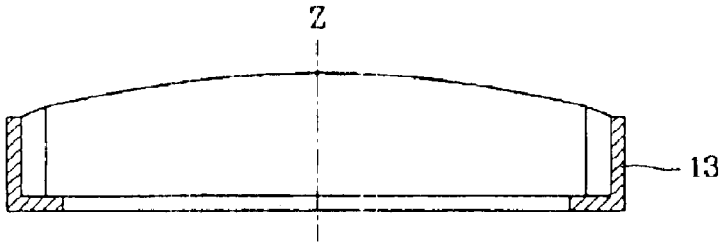
FIG. 5C CONVENTIONAL ART
FIG. 5C is a transverse sectional view of FIG. 5A.
Figure 6:
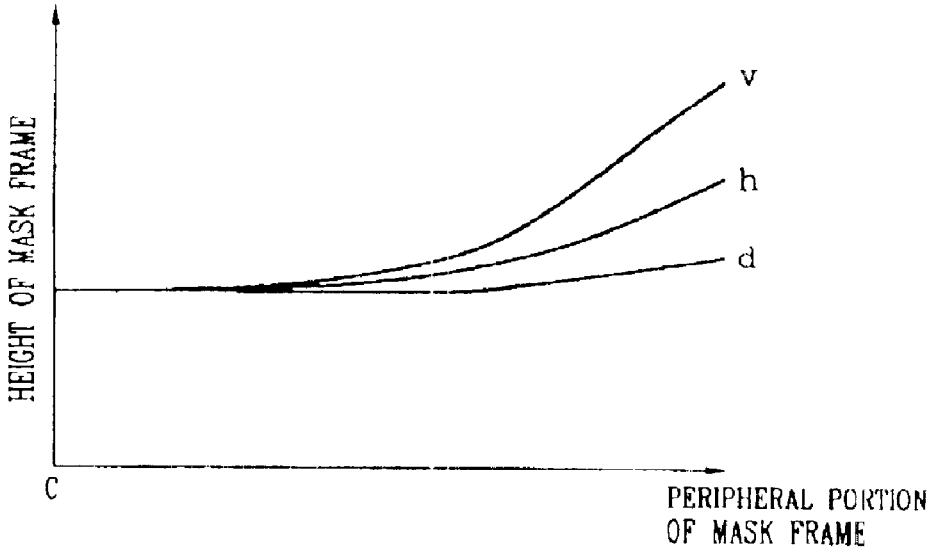
FIG. 6 CONVENTIONAL ART
FIG. 6 is a graph showing heights of a mask frame according to a long axis X, a short axis Y and a diagonal axis of a mask frame in the cathode ray tube in accordance with the conventional art.
Figure 7:
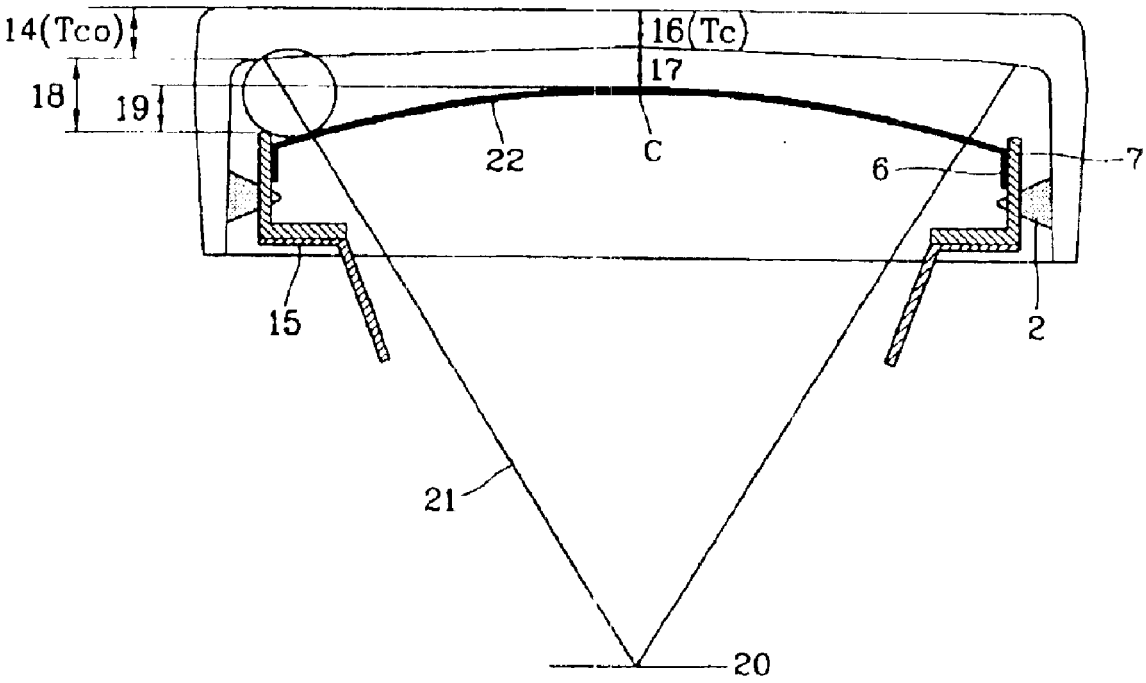
FIG. 7 CONVENTIONAL ART
FIG. 7 is a schematic view illustrating processes that the electron beam is deflected from a deflection center, passes through a shadow mask, and reaches to a fluorescent screen of a panel in a cathode ray tube in accordance with the conventional art.
Figure 8:
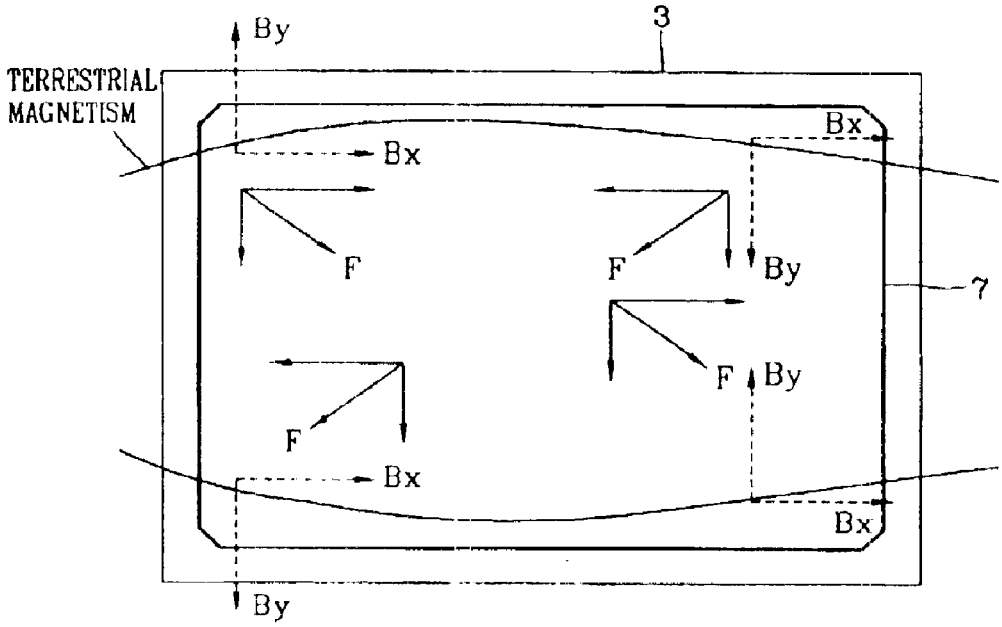
FIG. 8 CONVENTIONAL ART
FIG. 8 is a schematic view showing a moving direction of the electron beam due to a terrestrial magnetism in a cathode ray tube in accordance with the conventional art.
Figure 9:
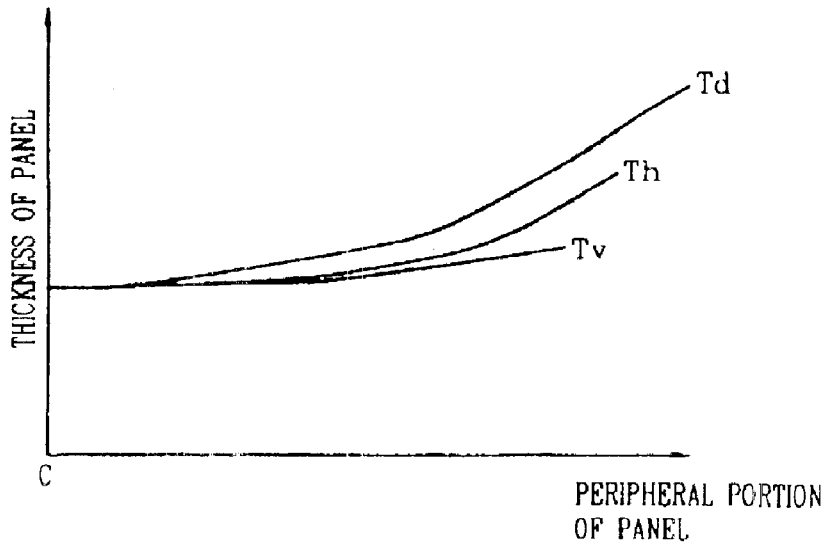
FIG. 9 CONVENTIONAL ART
FIG. 9 is a graph showing thicknesses according to a long axis X, a short axis Y and a diagonal axis of a panel of a cathode ray tube in accordance with the conventional art.

As shown in FIG. 9, a panel 3 having a substantially flat outer surface has a thickness Tv in a short axis direction, a thickness Th in a long axis direction and a thickness Td in a diagonal axis direction of the panel 3, and the thicknesses Tv, Th and Td become larger toward a peripheral portion of the panel 3.

Therefore, a curvature radius of an inner surface of the panel 3 is smaller than a curvature radius of the outer surface of the panel 3.

Figure 10:
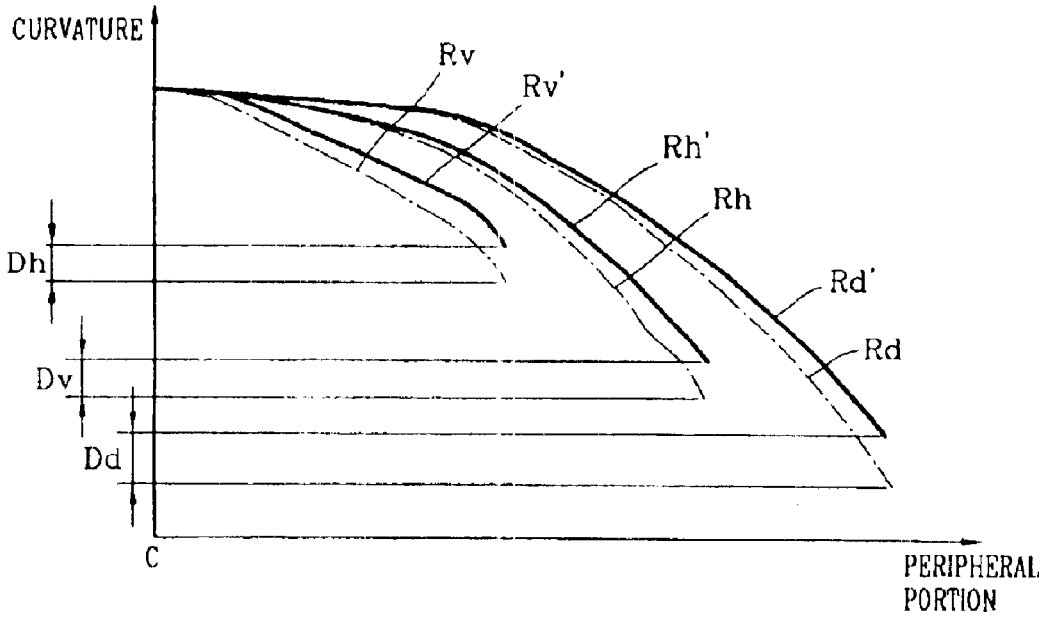
FIG. 10 CONVENTIONAL ART
FIG. 10 is a schematic view showing curvatures of an inner surface of a panel and curvatures of a main surface of a shadow mask according to a long axis, a short axis and a diagonal axis of the panel in a cathode ray tube in accordance with the conventional art.

As shown in FIG. 10, an inner surface of the panel has a curvature radius Rv' in the short axis direction, a curvature radius Rh' in the long axis direction and a curvature radius Rd in the diagonal axis direction of the panel 3. Also, the curvature radius Rv' is smaller than a curvature radius Rh', and the curvature radius Rh' is smaller than the curvature radius Rd'.

Meanwhile, a shadow mask 5 also has a curvature radius corresponding to the curvature radius of the inner surface of the panel 3, it is desirable that a curvature radius Rv in the diagonal axis direction, a curvature radius Rh in the short axis direction and a curvature radius Rd in the diagonal axis direction of the shadow mask 5 are smaller than each of the curvature radius Rv' in the short axis direction, the curvature radius Rh in the long axis direction and the curvature radius Rd in the diagonal axis direction of the inner surface of the panel.

Particularly, it is more desirable that the curvature radius Rd in the diagonal axis direction of the shadow mask 5 is smaller than the curvature radius Rd' in the diagonal axis direction of the inner surface of the panel 3.

Figure 11:
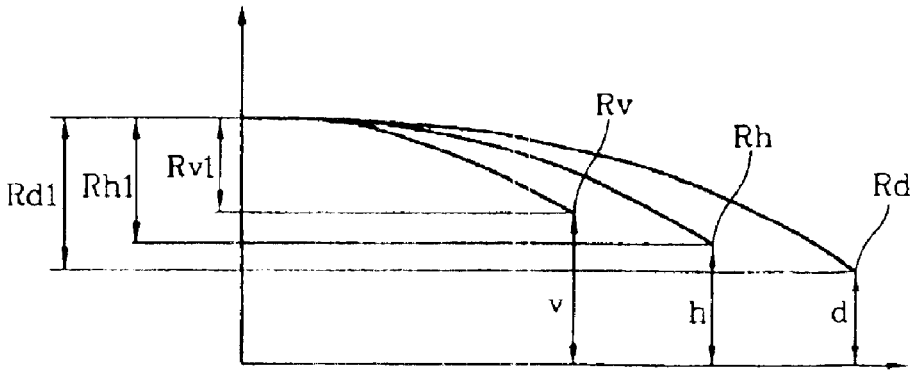
FIG. 11 CONVENTIONAL ART
FIG. 11 is a graph showing heights of a long axis X, a short axis Y and a diagonal axis of mask frame according to curvatures of a main surface of a shadow mask in a cathode ray tube in accordance with the conventional art.

Here, as shown in FIG. 11, the size of the curvature radius Rd in the diagonal axis direction of the shadow mask is Rd1, the size of the curvature radius Rh in the long axis direction is Rh1 and the size of the curvature radius Rv in the short axis direction is Rv1.

Figure 12:
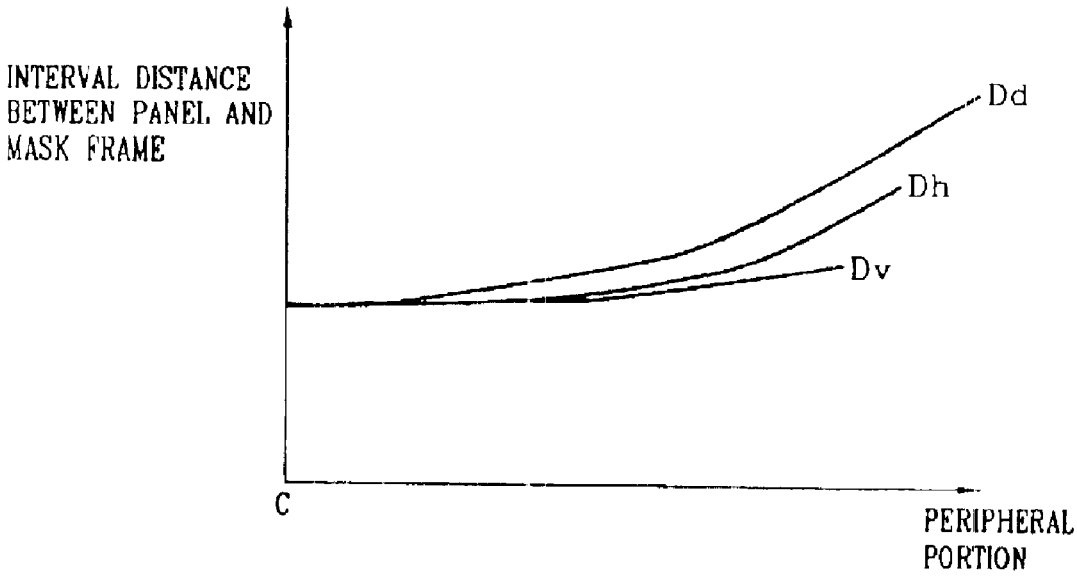
FIG. 12 CONVENTIONAL ART
FIG. 12 is a graph showing interval distance between a panel and a mask frame according to a long axis X, a short axis Y and a diagonal axis of the panel in a cathode ray tube in accordance with the conventional art.

Also, as shown in FIG. 12, a distance between the inner surface of the panel 3 and a mask frame 70 is represented by a distance Dv in the short axis direction, a distance Dh in the long axis and a distance Dd in the diagonal axis direction, the distances Dv, Dh and Dd become larger toward a peripheral portion of the panel 3, and the distance Dd in the diagonal axis direction is larger than the distances Dv and Dh.

Figure 13:
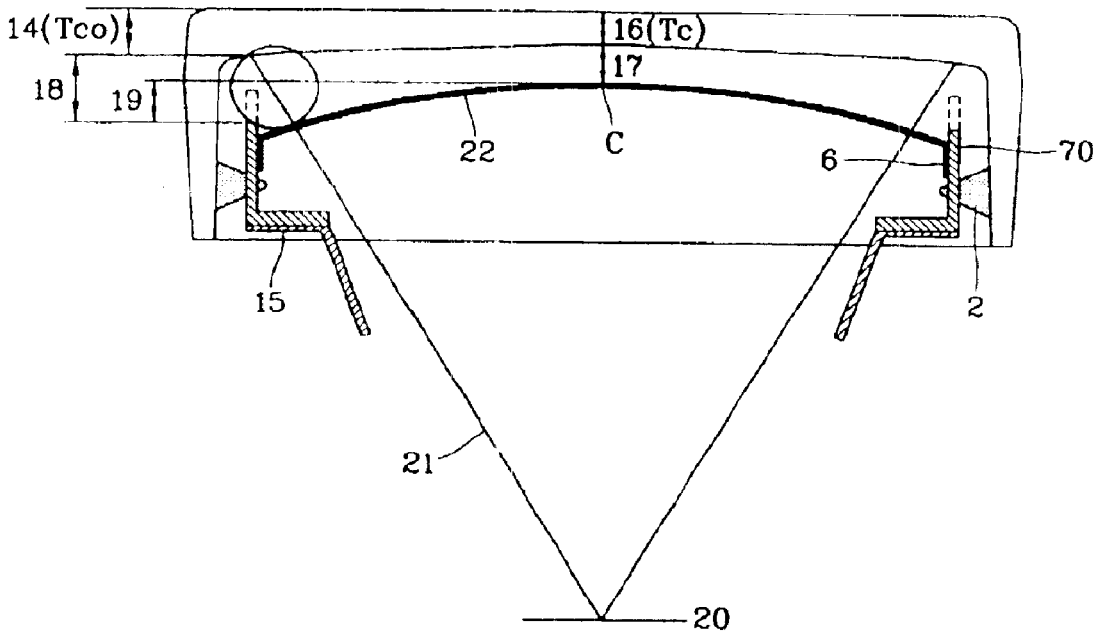
FIG. 13 is an exemplary view showing a mask frame wherein an end portion of a diagonal axis is increased in a cathode ray tube in accordance with the present invention.
Figure 14:
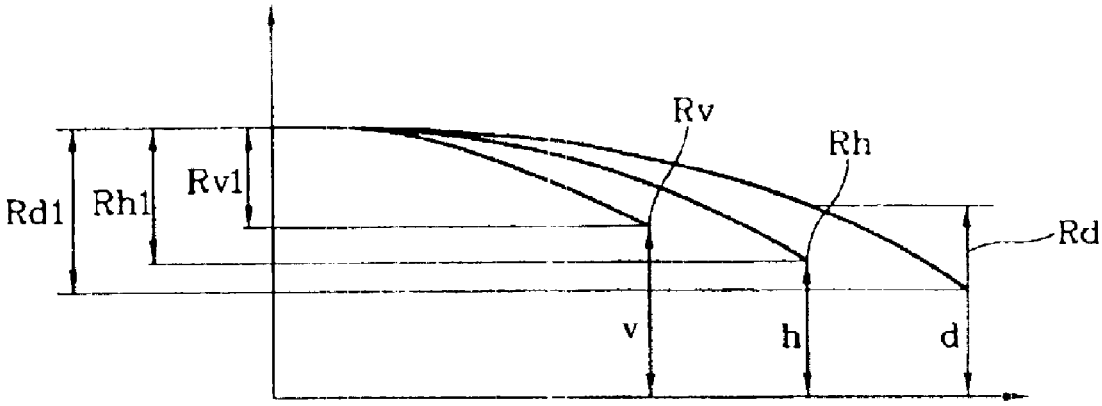
FIG. 14 is a graph showing heights of a long axis X, a short axis Y and a diagonal axis of the mask frame according to a curvature of the main surface of a shadow mask in a cathode ray tube in accordance with the present invention.

Therefore, as shown in FIGS. 13 and 14, since an electron beam 21 reaches to a fluorescent screen on the inner surface of the panel 3 at a predetermined distance from a diagonal portion of the mask frame 70, it is possible to increase a height d of the diagonal portion of the mask frame 70.

Figure 15:
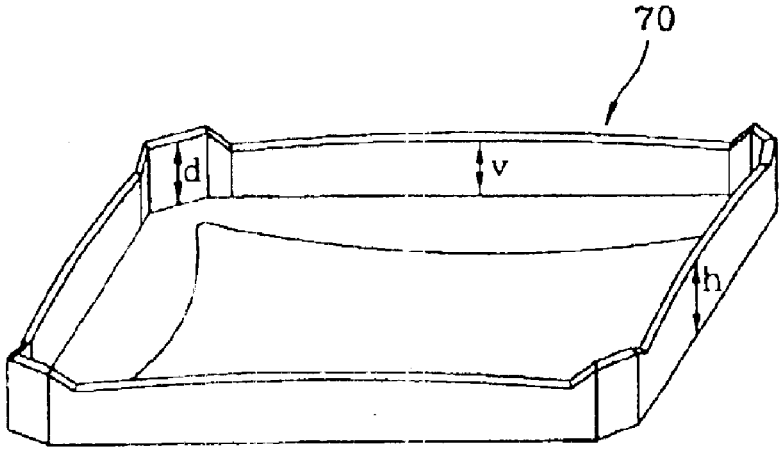
FIG. 15 is a perspective view showing a mask frame of a cathode ray tube in accordance with the present invention.

Here, as shown in FIG. 15, the height of a center of the diagonal portion of the mask frame 70 is d, the height of a center of a short side portion of the mask frame 70 is h, and the height of a center of a long side portion of the mask frame 70 is v.

That is, as shown in Table 4, as the distance between the inner surface of the panel 3 and the diagonal portion of the mask frame 70 is reduced by increasing the height d of the diagonal portion of the mask frame 70, the amount of displacement of electron beam resulting from the changing of the terrestrial magnetism is reduced.

TABLE 4

| height of diagonal portion of mask | amount of displacement of electron beam according to changing direction of terrestrial magnetism (μm) | | | | |
|---|---|---|---|---|---|
| frame (d, mm) | 5 deg | 10 deg | 15 deg | 20 deg | 25 deg |
| 55 | 15 | 20 | 25 | 30 | 35 |
| 58 | 14 | 18.5 | 23 | 27.5 | 34 |
| 61 | 13.8 | 17 | 22.5 | 26 | 33.5 |
| 64 | 13 | 16.5 | 21 | 25.2 | 33 |
| 67 | 12.7 | 15.8 | 20.7 | 24.2 | 32.2 |
| 70 | 12 | 15 | 20.2 | 24 | 29 |
| 73 | 11.9 | 14.8 | 19.8 | 23.2 | 28 |

Therefore, the effect of reducing the amount of displacement of the electron beam can be obtained when the height ratios of the mask frame 70 satisfy the following condition.

$$d/v \geqq 0.9,\ d/h \geqq 0.9 \quad (1)$$

More preferably, according to designing characteristic of the color cathode ray tube, the heights of the mask frame 70 satisfy the following condition.

$$d \geqq h,\ d \geqq v \quad (2)$$

Also, the heights h and v of the short side portion and the long side portion of the mask frame satisfy the following Formula (3) or Formula (4).

$$v \geqq h \quad (3)$$

$$h \geqq v \quad (4)$$

On the other hand, a preferred range of the height ratio for improving the performance characteristics and the manufacturing process of cathode ray tube is provided as following relations.

$$0.9 \leqq d/v \leqq 1.15 \quad (5)$$

$$0.95 \leqq d/h \leqq 1.2 \quad (6)$$

Figure 16:
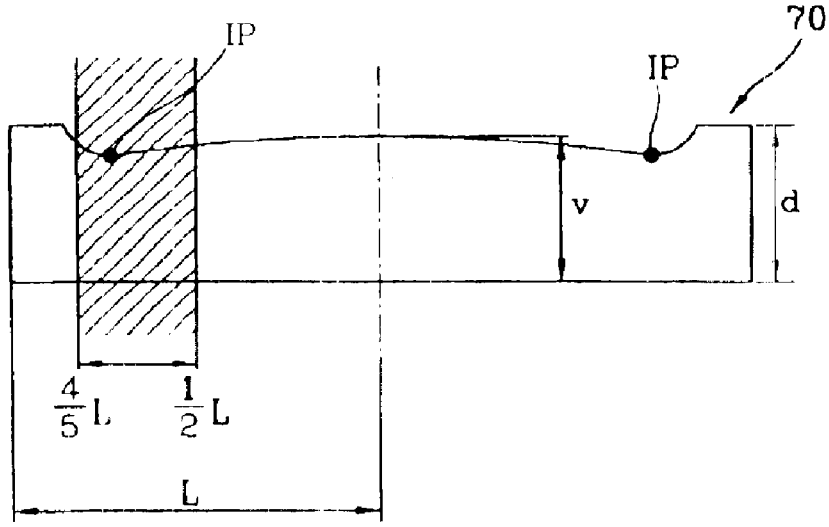
FIG. 16 is a side view showing a shape of a long side portion of the mask frame of FIG. 15.

Meanwhile, as shown in FIG. 16, the long side portion of the mask frame 70 is symmetrically formed around the center thereof, and an upper side of the long side portion of the mask frame is formed as continuous curve of substantially sinusoidal course by having at least one inflection point IP from the center of the long side portion toward an end side of the long side portion. That is, the half shape of the long side portion is formed to have a height which gradually decreases and increases from the center of the long side portion to the end side of the long side portion.

In addition, in case that the half of a length from the center of the long side portion to the end side of the long side portion of the mask frame 70 is L, the inflection point IP is positioned in the range of L/2 to 4L/5 of the long side portion. At this time, as the embodiment, the inflection point IP is placed in about 63.5% of the length L of the long side portion.

Figure 17:
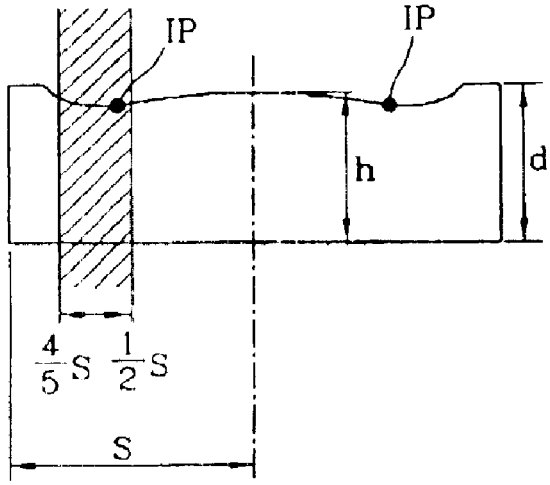
FIG. 17 is a side view showing a shape of a short side portion of the mask frame of FIG. 15.

Also, as shown in FIG. 17, the short side portion of the mask frame 70 is symmetrically formed around the center thereof, and an upper side of the short side portion of the mask frame is formed as continuous curve of substantially sinusoidal course by having at least one inflection point IP from the center of the short side portion toward an end side of the short side portion. That is, the half shape of the short side portion is formed to have a height which gradually decreases and increases from the center of the short side portion to the end side of the short side portion.

In addition, in case that the half of a length from the center of the short side portion to the end side of the short side portion of the mask frame 70 is S, the inflection point IP is positioned in the range of S/2 to 4S/5 of the short side portion. At this time, as the embodiment, the inflection point IP is placed in about 52.5% of the length S of the short side portion.

That is, since the long side portion and the short side portion of the mask frame are formed as described above, the volume of the mask frame which causes thermal deformation is reduced, and the weight of the mask frame is decreased, thereby improving a performance characteristics and drop characteristics of the cathode ray tube.

Figure 18:
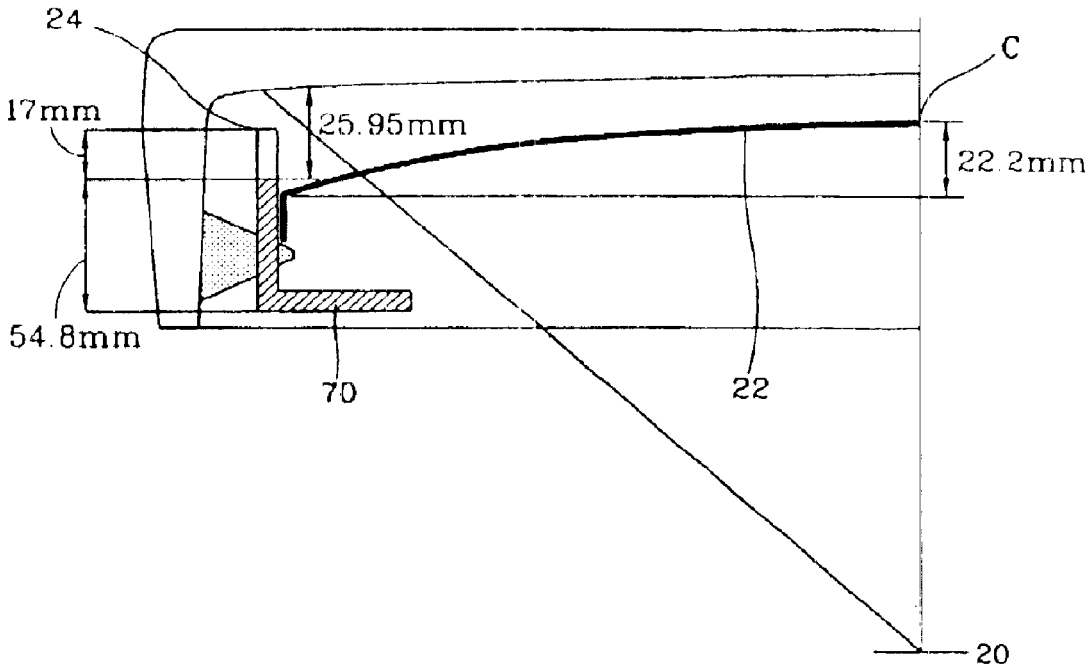
FIG. 18 is a schematic sectional view showing a mask frame of a cathode ray tube in accordance with the present invention.

FIG. 18 is a schematic section view showing a mask frame of a cathode ray tube in accordance with the embodiment of the present invention.

As shown in FIG. 18, a thickness of a center portion of a tinted panel is 12.5 mm, and a thickness of peripheral portion of the panel is 24.25 mm.

Also, the height from the center of the inner surface of the panel to the center of the main surface 22 of the shadow mask is 22.2 mm, the height of the diagonal portion is 54.8 mm, and the distance between the inner surface of the peripheral portion of the panel and the diagonal portion of the mask frame is 25.95 mm.

Therefore, it is possible to increase the height of the diagonal portion from 54.8 mm to 80.75 mm.

Figure 19:
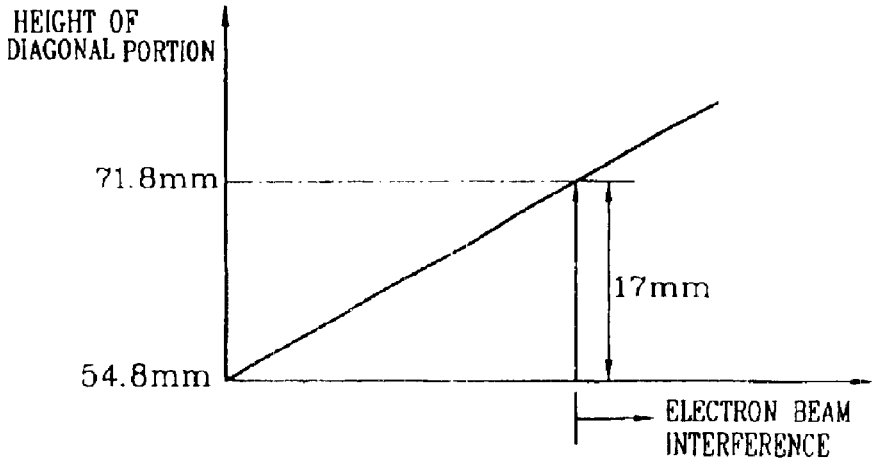
FIG. 19 is a graph illustrating a reason why a height of a diagonal axis of frame of the cathode ray tube of the present invention is limited as 17 mm.

However, since the electron beam is deflected with a predetermined deflection angle, in case that the height of the diagonal portion of the mask frame is increased more than 17 mm from 54.8 mm; the electron beam interference phenomenon is generated by the diagonal portion of the mask frame. Therefore, as shown in FIG. 19, the height of the diagonal portion should be increased within 17 mm so as to prevent the interference of the electron beam.

According to the present invention, the height d of the diagonal portion of the mask frame 70 is higher than the height h of the short side portion and the height v of the long side portion of the mask frame 70. Therefore, the amount of displacement of the electron beam resulting from the terrestrial magnetism can be reduced without changing of the material or the shape of the inner shield.

As shown in Table 5, in case that the height d of the diagonal portion of the mask frame 70 is 17 mm higher than the heights h and v of the short side portion and the long side portion, the amount of displacement of the electron beam decreases more than 6 μm, thus to improve the direction margin as about 7 degrees.

Further, a defect of color purity can be prevented by reducing the amount of displacement of the beam, in spite of increasing the width of the fluorescent screen, to prevent lowering of the brightness caused by the panel tinting.

TABLE 5

| panel | optical transmittance (%) center portion/ peripheral portion | height of diagonal portion of mask frame (mm) | width of fluorescent screen Gs (μm) center portion/ peripheral portion | amount of displacement of electron beam (μm) | direction margin (deg) |
|---|---|---|---|---|---|
| coated | 54.41/46.51 | 54.8 | 170/185 | 35 | 25 |
| tinted | 51.15/25.56 | 54.8 | 160/230 | 35 | 18 |
| tinted | 51.15/25.56 | 71.8 | 160/230 | 29 | 25 |

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A color cathode ray tube comprising a panel having a substantially flat outer surface, a funnel mounted on a rear side of the panel, a shadow mask including a plurality of electron beam through holes, and a mask frame for supporting the shadow mask;

said mask frame satisfying the following condition:

$$d/v \geqq 0.9,\ d/h \geqq 0.9$$

wherein d is a height of a diagonal portion of the mask frame, h is a height of a short side portion of the mask frame, and v is a height of a long side portion of the mask frame.

2. The color cathode ray tube of claim 1, wherein the mask frame satisfies the following conditions $$0.9 \leqq d/v \leqq 1.15,\ 0.95 \leqq d/h \leqq 1.2.$$

3. The color cathode ray tube of claim 1, wherein a height of the long side portion of the mask frame gradually decreases and increases from the center of the long side portion toward an end side of the long side portion in the range of L/2 to 4L/5 of the long side portion;

wherein L is half of a length from the center of the long side portion toward the end side of the long side portion of the mask frame.

4. The color cathode ray tube of claim 1, wherein the mask frame satisfies the following conditions $$d/v \geqq 1.0,\ d/h \geqq 1.0.$$

5. The color cathode ray tube of claim 1, wherein a height of the short side portion of the mask frame gradually decreases and increases from the center of the short side portion toward an end side of the short side portion in the range of S/2 to 4S/5 of the short side portion;

wherein S is half of a length from the center of the short side portion toward the end side of the short side portion of the mask frame.

6. The color cathode ray tube of claim 1, wherein an upper side of the long side portion of the mask frame is formed as continuous curve of substantially sinusoidal course by having at least one inflection point from the center of the long side portion toward an end side of the long side portion.

7. The color cathode ray tube of claim 6, wherein the inflection point is placed in the range of L/2 to 4L/5 of the long side portion;

wherein L is half of a length from the center of the long side portion toward the end side of the long side portion of the mask frame.

8. The color cathode ray tube of claim 1, wherein an upper side of the short side portion of the mask frame is formed as continuous curve of substantially sinusoidal course by having at least one inflection point from the center of the short side portion toward an end side of the short side portion.

9. The color cathode ray tube of claim 8, wherein the inflection point is placed in the range of S/2 to 4S/5 of the short side portion;

wherein S is half of a length from the center of the short side portion toward the end side of the short side portion of the mask frame.

10. The color cathode ray tube of claim 1, wherein the mask frame satisfies the following condition $$d \geqq v \geqq h.$$

11. The color cathode ray tube of claim 1, wherein the mask frame satisfies the following condition $$d \geqq h \geqq v.$$

12. The color cathode ray tube of claim 1, wherein the panel satisfies the following condition $$Pc \leqq 54\%$$

wherein Pc is an optical transmittance in a center portion of the panel.

13. The color cathode ray tube of claim 1, wherein the panel satisfies the following condition $$Pco \leqq 26\%$$

wherein Pco is an optical transmittance in a peripheral portion of the panel.

14. The color cathode ray tube of claim 1, wherein the panel satisfies the following condition $$Tc \leqq 13.5\ \text{mm}$$

wherein Tc is a height of a center portion of the panel.

15. The color cathode ray tube of claim 1, wherein the panel satisfies the following condition $$Tco/Tc < 2.4$$

wherein Tc is a height of a center portion of the panel, and Tco is a height of a peripheral portion of the panel.

16. A color cathode ray tube comprising a panel having a substantially flat outer surface, a funnel mounted on a rear side of the panel, a shadow mask including a plurality of electron beam through holes and a mask frame for supporting the shadow mask;

said mask frame satisfying the following condition:

$$d \geqq h,\ d \geqq v$$

wherein d is a height of a diagonal portion of the mask frame, h is a height of a short side portion of the mask frame, and v is a height of a long side portion of the mask frame.

17. The color cathode ray tube of claim 16, wherein the mask frame satisfies the following condition $$d \geqq v \geqq h.$$

18. The color cathode ray tube of claim 16, wherein the mask frame satisfies the following condition $$d \geqq h \geqq v.$$

19. The color cathode ray tube of claim 16, wherein the panel satisfies the following condition $$Pc \leqq 54\%$$

wherein Pc is an optical transmittance in a center portion of the panel.

20. The color cathode ray tube of claim 16, wherein the panel satisfies the following condition $$Pco \leqq 26\%$$

wherein Pco is an optical transmittance in a peripheral portion of the panel.

21. The color cathode ray tube of claim 16, wherein the panel satisfies the following condition $$Tc \leqq 13.5 \text{ mm}$$

wherein Tc is a height of a center portion of the panel.

22. The color cathode ray tube of claim 16, wherein the panel satisfies the following condition $$Tco/Tc < 2.4$$

wherein Tc is a height of a center portion of the panel, and Tco is a height of a peripheral portion of the panel.

23. The color cathode ray tube of claim 1, wherein d is no greater than 17 mm higher than h and d is no greater than 17 mm higher than v.

24. The color cathode ray tube of claim 16, wherein d is no greater than 17 mm higher than h and d is no greater than 17 mm higher than v.

* * * * *